US009311866B2

(12) United States Patent
Dai

(10) Patent No.: US 9,311,866 B2
(45) Date of Patent: Apr. 12, 2016

(54) METHOD FOR SELECTING FRC PATTERN

(71) Applicant: Shenzhen China Star Optoelectronics Technology Co., Ltd., Shenzhen, Guangdong (CN)

(72) Inventor: Ye Dai, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 530 days.

(21) Appl. No.: 13/822,293

(22) PCT Filed: Jan. 11, 2013

(86) PCT No.: PCT/CN2013/070380

§ 371 (c)(1),
(2) Date: Mar. 12, 2013

(87) PCT Pub. No.: WO2014/107887

PCT Pub. Date: Jul. 17, 2014

(65) Prior Publication Data

US 2015/0302807 A1 Oct. 22, 2015

(30) Foreign Application Priority Data

Jan. 8, 2013 (CN) ..... 2013 1 0006243

(51) Int. Cl.
*G09G 3/36* (2006.01)

(52) U.S. Cl.
CPC ..... *G09G 3/3607* (2013.01); *G09G 3/3614* (2013.01); *G09G 3/3685* (2013.01); *G09G 2310/027* (2013.01); *G09G 2320/0242* (2013.01); *G09G 2320/0285* (2013.01); *G09G 2340/0435* (2013.01)

(58) Field of Classification Search
CPC . G09G 3/2044; G09G 3/3696; G09G 3/3614; G09G 3/2018; G09G 3/2051; G09G 2320/0233; G09G 2310/027; G09G 2320/0242
USPC ..... 345/87, 89, 96, 208–209, 690
See application file for complete search history.

(56) References Cited

U.S. PATENT DOCUMENTS

2005/0104834 A1* 5/2005 Tsuchihashi ..... G09G 3/3614 345/96
2008/0055219 A1* 3/2008 Jung ..... G09G 3/2022 345/89

FOREIGN PATENT DOCUMENTS

CN 1573903 A 2/2005
CN 1661660 A 8/2005

(Continued)

*Primary Examiner* — Jennifer Nguyen
(74) *Attorney, Agent, or Firm* — Andrew C. Cheng

(57) ABSTRACT

The present invention provides a method for selecting FRC pattern, which includes (1) providing a display device, which includes a display panel, a signal controller including a look-up table and a data processor, and a data driver; (2) the display panel displaying an image and the signal controller supplying and expanding polarity distribution charts of two adjacent frames of the image; (3) establishing matrixes A, B corresponding to the frames; (4) the data processor retrieving and expanding one FRC pattern from the look-up table into matrixes C, D; (5) the data processor making operation on matrixes A, B, C and D to obtain a two-dimensional chart; and (6) determining if bright/dark strips occur according to the two-dimensional chart, whereby if the strips occur, then repeat steps (4)-(6) and if no such strips occur, then the FRC pattern is kept for subsequent use.

11 Claims, 7 Drawing Sheets

(56) References Cited

FOREIGN PATENT DOCUMENTS

| | | | |
|---|---|---|---|
| CN | 101751845 | A | 6/2010 |
| JP | 2003002695 | A | 1/2003 |
| JP | 2007212994 | A | 8/2007 |
| KR | 956343 | B1 | 5/2010 |

* cited by examiner

METHOD FOR SELECTING FRC PATTERN

BACKGROUND OF THE INVENTION

1. Field of the Invention

The present invention relates to liquid crystal displaying techniques, and in particular to a method for selecting FRC (Frame Rate Conversion) pattern.

2. The Related Arts

Today's vigorous development of science and technology brings constantly innovated information products to suit various needs of the public. Displays of the early time are most CRT (Cathode Ray Tube) displays, which are bulky and consume a large amount of electrical power and may generate radiation that is hazard to body health for users who use the displays for a long time. Thus, for the displays that are currently available in the market, liquid crystal displays (LCDs) are gradually taking the place of the CRT displays.

The liquid crystal displays have a variety of advantages, such as thin device body, low power consumption, and being free of radiation, and is thus widely used. Most of the LCDs that are currently available in the market are backlighting LCDs, which comprise a liquid crystal panel and a backlight module. The operative principle of the liquid crystal panel is that liquid crystal molecules are interposed between two parallel glass substrates and the liquid crystal molecules are controlled to change direction by application of electricity in order to refract out light emitting from the backlight module for generating images. Since the liquid crystal panel itself does not emit light, light must be provided by the backlight module in order to normally display images.

Driving achieved through alternate-current driving is often adopted to drive the liquid crystal module of an LCD. Alternate-current driving is an essential characteristic of LCD liquid crystal module and regular LCD liquid crystal modules uses alternate-current signals to prevent formation of charge accumulation on upper and lower substrates of liquid crystal cell. A pixel is operated by alternately applying positive voltage and negative voltage (positive and negative being determined with reference to ITO voltage of color filter) to drive rotation of liquid crystal molecules, with "frame" as time unit.

FRC (Frame Rate Conversion) is a commonly used gray level expansion method. A grey level between two adjacent grey levels can be created through combined use of space and time. Such a technique is often applied to white tracking of LCD liquid crystal module for expanding the number of colors that can be shown by a liquid crystal panel so as to provide expanded flexibility of selection for color mixture operation.

Referring to FIGS. 1 and 2, the FRC grey level expansion method generally comprises two types, namely space domain FRC and time domain FRC. The space domain FRC is based on the fact that naked eyes of human beings cannot distinguish a single pixel and is operated by alternately setting adjacent grey levels on adjacent pixels so that the grey levels perceived by human eyes show an intermediate grey level. The time domain FRC is based on the fact that naked eyes of human beings cannot distinguish the image of a single frame (which is around 16.7 ms for 60 Hz) and is operated by alternately displaying adjacent grey levels on the same pixel so that the grey levels perceived by human eyes show an intermediate grey level.

The process of FRC is generally defined by a timing control chip (Tcon) of a driving circuit for liquid crystal module. To lower down the potential risks of deterioration of resolution in time domain FRC and reduction of frame rate in space domain FRC, the timing control chip generally adopts a combined process of both space domain FRC and time domain FRC, as illustrated in FIG. 3.

Generally, the alternate-current driving and FRC are both important measures for enhancing quality of liquid crystal panel and have both been widely used. However, in certain applications, they cause optical issues (such as the displayed image showing alternate occurrences of bright and dark strips). For example, in an alternate-current driving method that adopts dot inversion, if FRC is used in combination to display a 0.5-level image of a pure color, then data signals will pull down the voltage of COM terminal, leading to periodical cross-talking and also making the display image showing water ripples.

The cause of these phenomena is illustrated in FIG. 4, where (a) is the inversion state in simply displaying green screen; (b) is the corresponding FRC patterns; (c) shows the coupling directions of the data signal to Vcom, wherein negative voltage is downward and positive voltage is upward when inversion an FRC are applied simultaneously; and (d) shows the change of frames, where asymmetric situation of the Vcom coupling is not eliminated and water ripple is observed.

Generally, Vcom will be coupled to show very low voltage and the influence caused by its superposition on signal voltage is very minute. However, for low grey levels, the V-T curve has a small slope and the voltage difference between adjacent grey levels is great. Under this condition, the coupling of Vcom shows significance. Consequently, water ripple is often observed in low grey level images.

SUMMARY OF THE INVENTION

An object of the present invention is to provide a method for selecting FRC pattern, which can effectively eliminate water ripple issue in dark-state pure-color grey-level images.

To achieve the object, the present invention provides a method for selecting FRC pattern, which comprises the following steps:

(1) providing a display device, wherein the display device comprises: a display panel, a signal controller electrically connected to the display panel, and a data driver that drives the display panel, the signal controller comprising: a look-up table and a data processor electrically connected to the look-up table, the look-up table storing a plurality of different FRC patterns;

(2) the data driver driving the display panel to display a pure color image, the signal controller supplying polarity distribution charts of two adjacent frames of the pure color image by applying an inversion operation and expanding the polarity distribution charts to m×n dimensions, where m and n are integer multiples of four;

(3) establishing matrixes A, B that respectively correspond to the two frames according to the two frames;

(4) the data processor selecting and retrieving one of the FRC patterns from the look-up table and expanding the FRC pattern to matrixes C, D of m×n dimensions;

(5) the data processor taking an operation on matrixes A, B, C, and D according to the formula A.*C+B.*D and making a two-dimensional chart on the result of the operation; and (6) determining whether bright/dark strips will occur according to the two-dimensional chart and repeating steps (4), (5), and (6) if the bright/dark strips will occur by retrieving another one of the FRC patterns from the look-up table to proceed with operation and determination and keeping the FRC pattern on if no bright/dark strip occurs.

After step (6), step (7) is further included to prompt that no FRC pattern can be used if all the FRC patterns have been tested and no result indicating there is no bright/dark strips can be obtained.

The inversion operation of step (2) comprises dot inversion and line inversion.

The dot inversion operation comprises: single-dot inversion, two-dot inversion, and three-dot inversion.

In step (3), positive polarity in the polarity distribution charts corresponds to an element "+1" of the matrixes A, B and negative polarity in the polarity distribution charts corresponds to an element "−1" of the matrixes A, B.

In step (4), elements "0" and "1" are used to expand the FRC pattern into matrixes C, D of m×n dimensions.

The plurality of FRC patterns is of 0.5 level.

The look-up table stores three different FRC patterns.

Each of the FRC patterns is in the form of a 4×4 data matrix.

The display panel comprises a plurality of pixels.

The present invention also provides a method for selecting FRC pattern, which comprises the following steps:

(1) providing a display device, wherein the display device comprises: a display panel, a signal controller electrically connected to the display panel, and a data driver that drives the display panel, the signal controller comprising: a look-up table and a data processor electrically connected to the look-up table, the look-up table storing a plurality of different FRC patterns;

(2) the data driver driving the display panel to display a pure color image, the signal controller supplying polarity distribution charts of two adjacent frames of the pure color image by applying an inversion operation and expanding the polarity distribution charts to m×n dimensions, where m and n are integer multiples of four;

(3) establishing matrixes A, B that respectively correspond to the two frames according to the two frames;

(4) the data processor selecting and retrieving one of the FRC patterns from the look-up table and expanding the FRC pattern to matrixes C, D of m×n dimensions;

(5) the data processor taking an operation on matrixes A, B, C, and D according to the formula A.*C+B.*D and making a two-dimensional chart on the result of the operation; and (6) determining whether bright/dark strips will occur according to the two-dimensional chart and repeating steps (4), (5), and (6) if the bright/dark strips will occur by retrieving another one of the FRC patterns from the look-up table to proceed with operation and determination and keeping the FRC pattern on if no bright/dark strip occurs; and wherein after step (6), step (7) is further included to prompt that no FRC pattern can be used if all the FRC patterns have been tested and no result indicating there is no bright/dark strips can be obtained;

wherein the inversion operation of step (2) comprises dot inversion and line inversion;

wherein the dot inversion operation comprises: single-dot inversion, two-dot inversion, and three-dot inversion;

wherein in step (3), positive polarity in the polarity distribution charts corresponds to an element "+1" of the matrixes A, B and negative polarity in the polarity distribution charts corresponds to an element "−1" of the matrixes A, B;

wherein in step (4), elements "0" and "1" are used to expand the FRC pattern into matrixes C, D of m×n dimensions;

wherein the plurality of FRC patterns are of 0.5 level;

wherein the look-up table stores three different FRC patterns;

wherein each of the FRC patterns is in the form of a 4×4 data matrix; and wherein the display panel comprises a plurality of pixels.

The efficacy of the present invention is that the present invention provides a method for selecting FRC pattern, which makes operation on a matrix that is obtained by expanding a dark-state grey-level FRC pattern and matrixes that are obtained by expanding polarity distribution charts of two adjacent frames of a pure color image displayed on a display panel according to a predetermined operation formula and prepares a two-dimensional chart with result of the operation by means of software in order to realize easy determination of whether the FRC pattern will cause water ripple and preventing the FRC pattern from causing water ripple issue.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, of the present invention will be apparent from the following detailed description of an embodiment of the present invention, with reference to the attached drawings. In the drawings.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
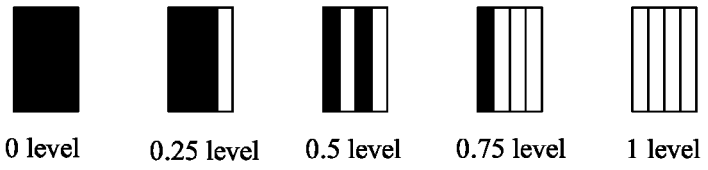
Fig. 1 (Prior Art)
FIG. 1 is a schematic view showing expansion of space domain FRC (Frame Rate Conversion)
Figure 2:
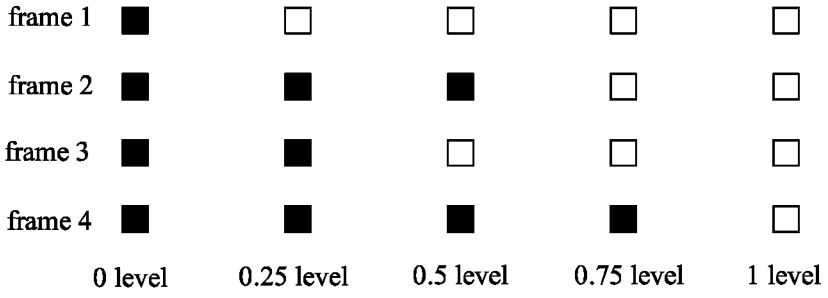
Fig. 2 (Prior Art)
FIG. 2 is a schematic view showing expansion of time domain FRC.
Figure 3:
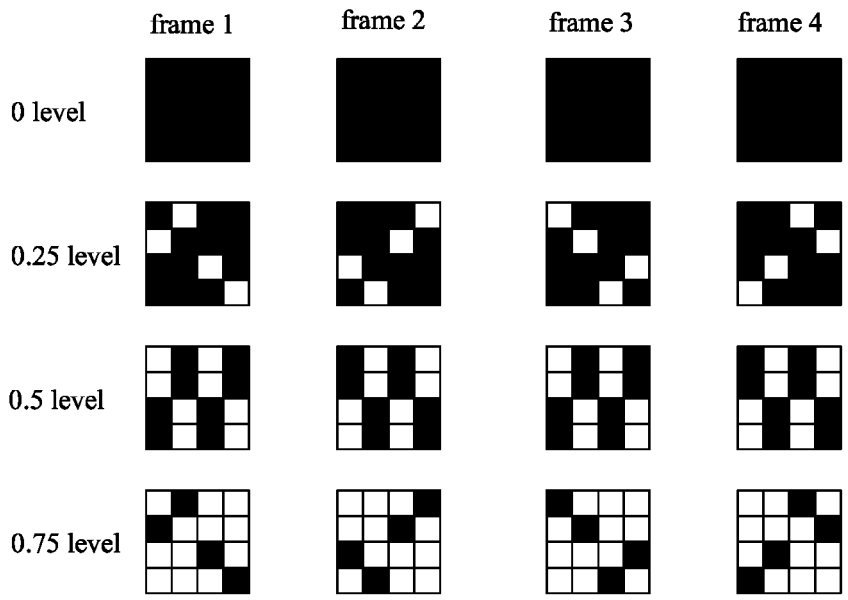
Fig. 3 (Prior Art)
FIG. 3 is a schematic view illustrating various known grey level FRC patterns.
Figure 4:
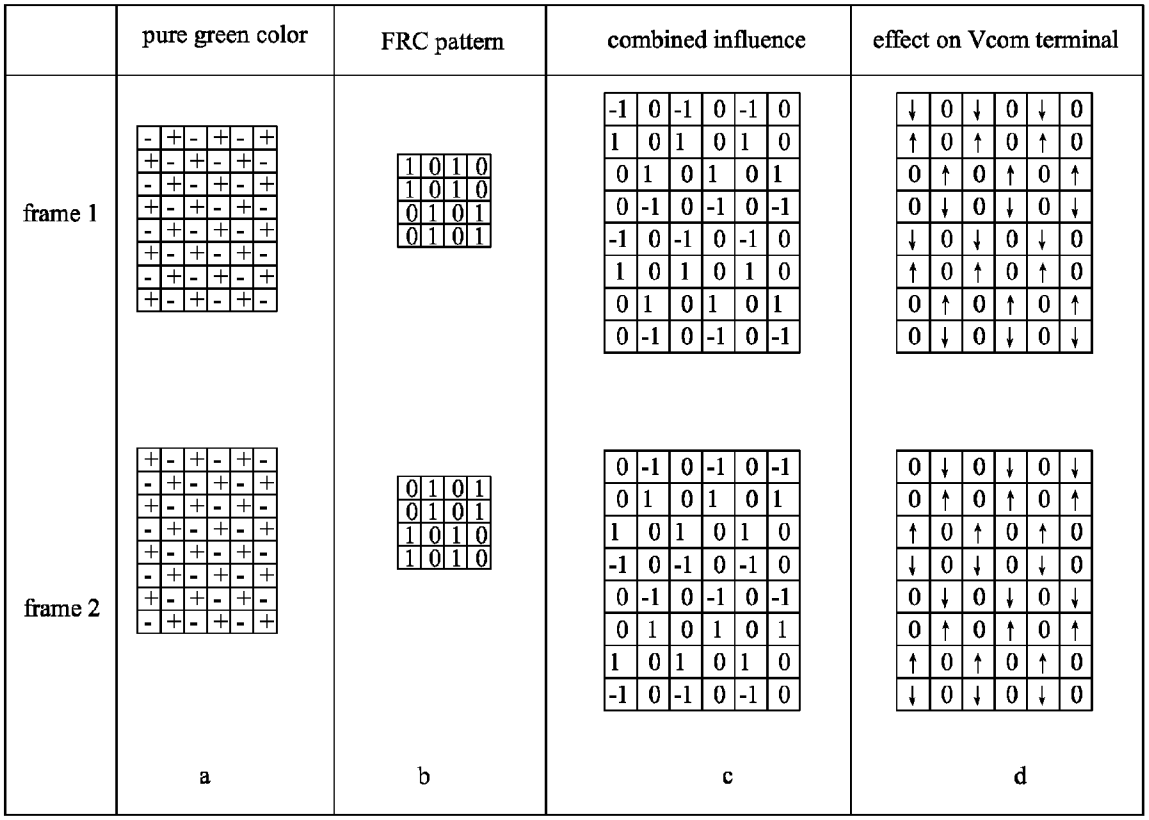
Fig. 4 (Prior Art)
FIG. 4 is schematic view illustrating causes of water ripple occurring in the known techniques.
Figure 5:
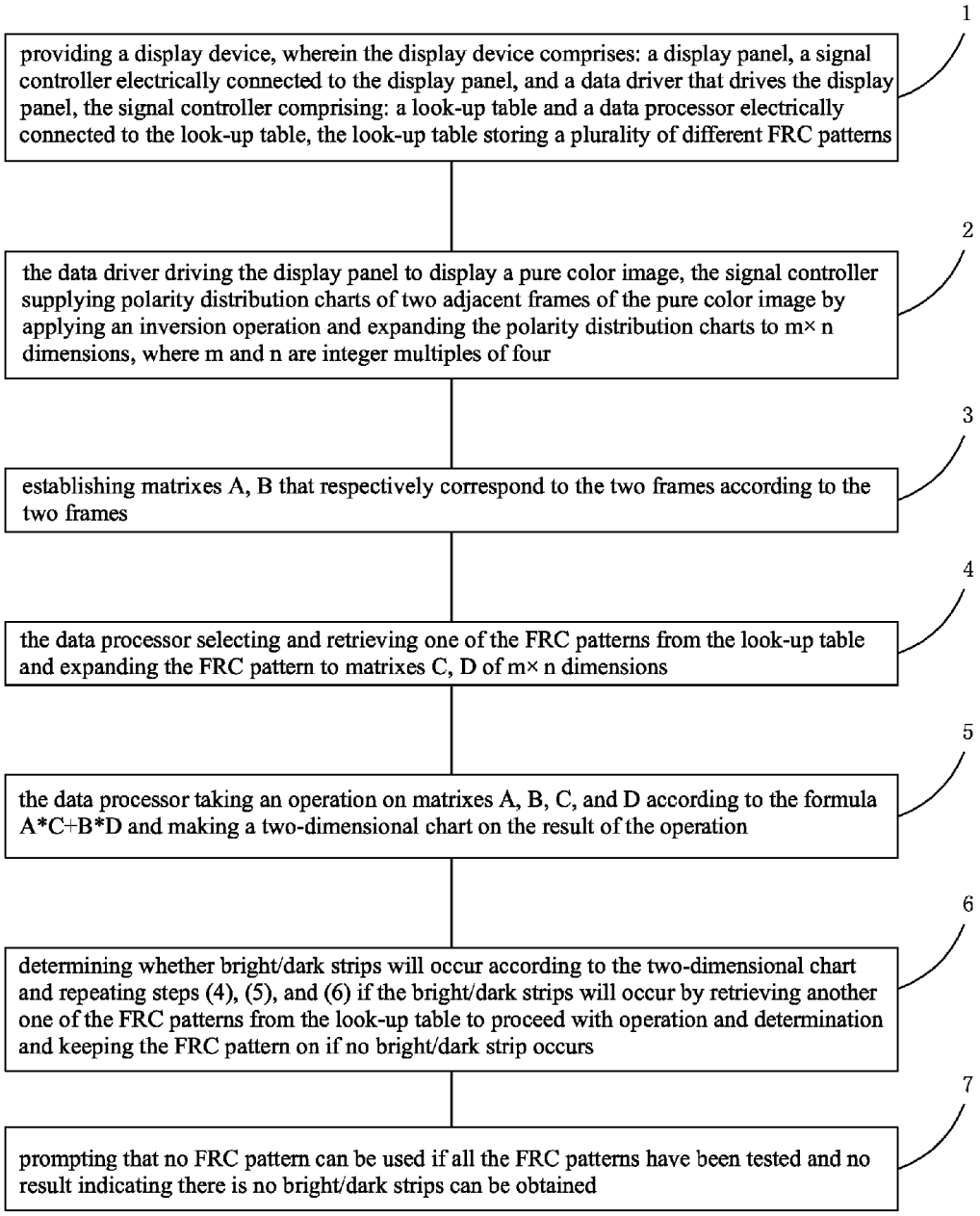
FIG. 5 is a flow chart illustrating a method for selecting FRC pattern according to the present invention.

Referring to FIG. 5, the present invention provides a method for selecting FRC pattern, which comprises the following steps:

Step 1: providing a display device, wherein the display device comprises: a display panel, a signal controller electrically connected to the display panel, and a data driver (not shown) that drives the display panel, the signal controller comprising: a look-up table and a data processor electrically connected to the look-up table, the look-up table storing a plurality of different FRC patterns.

Figure 6:
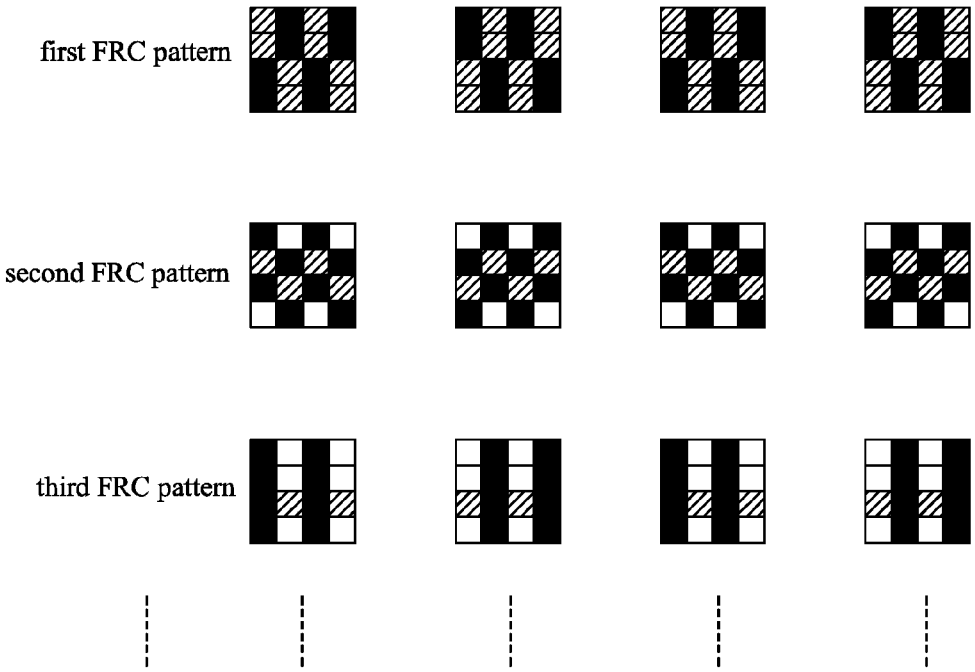
FIG. 6 is a schematic view showing FRC patterns stored in a look-up table used in the method for selecting FRC pattern according to the present invention.

Referring to FIG. 6, since the water ripple issue is only observable in a low grey level image, in the instant preferred embodiment, the plurality of FRC patterns are selected to be 0.5-level and each of the FRC patterns is set in the form of a 4×4 data matrix. The different FRC patterns stored in the look-up table are preferably of a number of three, which includes first FRC pattern, second FRC pattern, and third FRC pattern, but is not limited to three.

The display panel comprises a plurality of pixels. The data driver applies data voltages that correspond to output image data supplied from the signal controller to the pixels in order to have the display panel display an image. The data processor converts the FRC pattern stored in the look-up table into the output image data.

Step 2: the data driver driving the display panel to display a pure color image, the signal controller supplying polarity distribution charts of two adjacent frames of the pure color image by applying an inversion operation and expanding the polarity distribution charts to m×n dimensions, where m and n are integer multiples of four.

The inversion operation used in Step 2 can be dot inversion or line inversion. The dot inversion will be taken as an example for the following description. The dot inversion operation can be: single-dot inversion, two-dot inversion, and three-dot inversion.

Step 3: establishing matrixes A, B that respectively correspond to the two frames according to the two frames.

In this step, positive polarity in the polarity distribution charts corresponds to an element "+1" of the matrixes A, B and negative polarity in the polarity distribution charts corresponds to an element "−1" of the matrixes A, B. Then, matrix A is

| | | | | | | | |
|---|---|---|---|---|---|---|---|
| 1 | −1 | 1 | −1 | 1 | −1 | 1 | −1 |
| −1 | 1 | −1 | 1 | −1 | 1 | −1 | 1 |
| 1 | −1 | 1 | −1 | 1 | −1 | 1 | −1 |
| −1 | 1 | −1 | 1 | −1 | 1 | −1 | 1 |
| 1 | −1 | 1 | −1 | 1 | −1 | 1 | −1 |
| −1 | 1 | −1 | 1 | −1 | 1 | −1 | 1 |
| 1 | −1 | 1 | −1 | 1 | −1 | 1 | −1 |
| −1 | 1 | −1 | 1 | −1 | 1 | −1 | 1 |

and matrix B is

| | | | | | | | |
|---|---|---|---|---|---|---|---|
| −1 | 1 | −1 | −1 | −1 | 1 | −1 | 1 |
| 1 | −1 | 1 | −1 | 1 | −1 | 1 | −1 |
| −1 | 1 | −1 | 1 | −1 | 1 | −1 | 1 |
| 1 | −1 | 1 | −1 | 1 | −1 | 1 | −1 |
| −1 | 1 | −1 | 1 | −1 | 1 | −1 | 1 |
| 1 | −1 | 1 | −1 | 1 | −1 | 1 | −1 |
| −1 | 1 | −1 | 1 | −1 | 1 | −1 | 1 |
| 1 | −1 | 1 | −1 | 1 | −1 | 1 | −1 |

Step 4: the data processor selecting and retrieving one of the FRC patterns from the look-up table and expanding the FRC pattern to matrixes C, D of m×n dimensions.

In this step, elements "0" and "1" are used to expand an FRC pattern into matrixes C, D of m×n dimensions. In the instant preferred embodiment, the first FRC pattern is used first and is expanded into matrixes C, D. If it is subsequently determined that the first FRC pattern may cause bright/dark strips, then the second FRC pattern is retrieved to take the operation. If the second FRC pattern still causes bright/dark strips, then the third FRC pattern is taken to do the operation. This process is repeated until no bright/dark strips occur or all the FRC patterns are used up.

For the first FRC pattern, matrix C is

| | | | | | | | |
|---|---|---|---|---|---|---|---|
| 1 | 0 | 1 | 0 | 1 | 0 | 1 | 0 |
| 1 | 0 | 1 | 0 | 1 | 0 | 1 | 0 |
| 0 | 1 | 0 | 1 | 0 | 1 | 0 | 1 |
| 0 | 1 | 0 | 1 | 0 | 1 | 0 | 1 |
| 1 | 0 | 1 | 0 | 1 | 0 | 1 | 0 |
| 1 | 0 | 1 | 0 | 1 | 0 | 1 | 0 |
| 0 | 1 | 0 | 1 | 0 | 1 | 0 | 1 |
| 0 | 1 | 0 | 1 | 0 | 1 | 0 | 1 |

and matrix D is

| | | | | | | | |
|---|---|---|---|---|---|---|---|
| 0 | 1 | 0 | 1 | 0 | 1 | 0 | 1 |
| 0 | 1 | 0 | 1 | 0 | 1 | 0 | 1 |
| 1 | 0 | 1 | 0 | 1 | 0 | 1 | 0 |
| 1 | 0 | 1 | 0 | 1 | 0 | 1 | 0 |
| 0 | 1 | 0 | 1 | 0 | 1 | 0 | 1 |
| 0 | 1 | 0 | 1 | 0 | 1 | 0 | 1 |
| 1 | 0 | 1 | 0 | 1 | 0 | 1 | 0 |
| 1 | 0 | 1 | 0 | 1 | 0 | 1 | 0 |

For the second FRC pattern, matrix C is

| | | | | | | | |
|---|---|---|---|---|---|---|---|
| 1 | 0 | 1 | 0 | 1 | 0 | 1 | 0 |
| 0 | 1 | 0 | 1 | 0 | 1 | 0 | 1 |
| 1 | 0 | 1 | 0 | 1 | 0 | 1 | 0 |
| 0 | 1 | 0 | 1 | 0 | 1 | 0 | 1 |
| 1 | 0 | 1 | 0 | 1 | 0 | 1 | 0 |
| 0 | 1 | 0 | 1 | 0 | 1 | 0 | 1 |
| 1 | 0 | 1 | 0 | 1 | 0 | 1 | 0 |
| 0 | 1 | 0 | 1 | 0 | 1 | 0 | 1 |

and matrix D is

| | | | | | | | |
|---|---|---|---|---|---|---|---|
| 0 | 1 | 0 | 1 | 0 | 1 | 0 | 1 |
| 1 | 0 | 1 | 0 | 1 | 0 | 1 | 0 |
| 0 | 1 | 0 | 1 | 0 | 1 | 0 | 1 |
| 1 | 0 | 1 | 0 | 1 | 0 | 1 | 0 |
| 0 | 1 | 0 | 1 | 0 | 1 | 0 | 1 |
| 1 | 0 | 1 | 0 | 1 | 0 | 1 | 0 |
| 0 | 1 | 0 | 1 | 0 | 1 | 0 | 1 |
| 1 | 0 | 1 | 0 | 1 | 0 | 1 | 0 |

For the third FRC pattern, matrix C is

| | | | | | | | |
|---|---|---|---|---|---|---|---|
| 1 | 0 | 1 | 0 | 1 | 0 | 1 | 0 |
| 1 | 0 | 1 | 0 | 1 | 0 | 1 | 0 |
| 1 | 0 | 1 | 0 | 1 | 0 | 1 | 0 |
| 1 | 0 | 1 | 0 | 1 | 0 | 1 | 0 |
| 1 | 0 | 1 | 0 | 1 | 0 | 1 | 0 |
| 1 | 0 | 1 | 0 | 1 | 0 | 1 | 0 |
| 1 | 0 | 1 | 0 | 1 | 0 | 1 | 0 |
| 1 | 0 | 1 | 0 | 1 | 0 | 1 | 0 |

and matrix D is

| | | | | | | | |
|---|---|---|---|---|---|---|---|
| 0 | 1 | 0 | 1 | 0 | 1 | 0 | 1 |
| 0 | 1 | 0 | 1 | 0 | 1 | 0 | 1 |
| 0 | 1 | 0 | 1 | 0 | 1 | 0 | 1 |
| 0 | 1 | 0 | 1 | 0 | 1 | 0 | 1 |
| 0 | 1 | 0 | 1 | 0 | 1 | 0 | 1 |
| 0 | 1 | 0 | 1 | 0 | 1 | 0 | 1 |
| 0 | 1 | 0 | 1 | 0 | 1 | 0 | 1 |
| 0 | 1 | 0 | 1 | 0 | 1 | 0 | 1 |

Step 5: the data processor taking an operation on matrixes A, B, C, and D according to the formula A.*C+B.*D and making a two-dimensional chart on the result of the operation.

In this step, matrixes A, B, C, and D are operated according to matrix manipulation rules.

Step 6: determining whether bright/dark strips will occur according to the two-dimensional chart and repeating Steps 4, 5, and 6 if the bright/dark strips will occur by retrieving another one of the FRC patterns from the look-up table to proceed with operation and determination and keeping the FRC pattern on if no bright/dark strip occurs.

In the instant preferred embodiment, the operation result of matrixes A and B and the first FRC pattern is as follows:

$A.^*C + B.^*D =$

| | | | | | | | |
|---|---|---|---|---|---|---|---|
| 1 | 1 | 1 | 1 | 1 | 1 | 1 | 1 |
| −1 | −1 | −1 | −1 | −1 | −1 | −1 | −1 |
| −1 | −1 | −1 | −1 | −1 | −1 | −1 | −1 |
| 1 | 1 | 1 | 1 | 1 | 1 | 1 | 1 |
| 1 | 1 | 1 | 1 | 1 | 1 | 1 | 1 |
| −1 | −1 | −1 | −1 | −1 | −1 | −1 | −1 |
| −1 | −1 | −1 | −1 | −1 | −1 | −1 | −1 |
| 1 | 1 | 1 | 1 | 1 | 1 | 1 | 1 |

Figure 7:
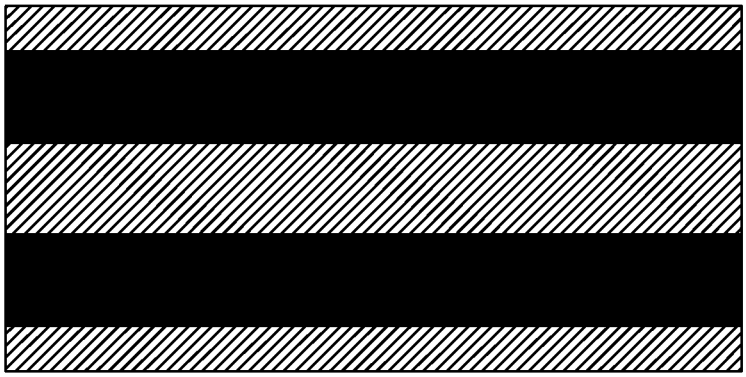
FIG. 7 is a schematic view showing a two-dimensional chart prepared according to the result of operation made on matrixes C and D that are obtained by expanding a first FRC pattern and matrixes A and B according to the method for selecting FRC pattern of the present invention.

Referring to FIG. 7, which is a schematic view showing a two-dimensional chart that is made with the operation results of matrixes A and B and the first FRC pattern by means of software, it can be seen from the chart that this particular FRC pattern will cause water ripple Issue.

The operation result of matrixes A and B and the second FRC pattern is as flows:

$A.^*C + B.^*D =$

| | | | | | | | |
|---|---|---|---|---|---|---|---|
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |

Figure 8:
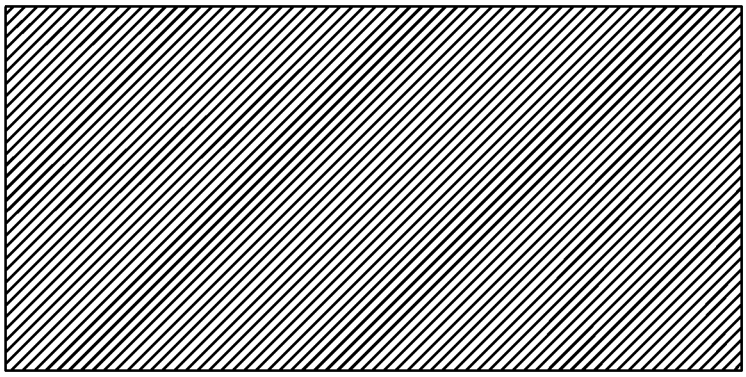
FIG. 8 is a schematic view showing a two-dimensional chart prepared according to the result of operation made on matrixes C and D that are obtained by expanding a second FRC pattern and matrixes A and B according to the method for selecting FRC pattern of the present invention.

Referring to FIG. 8, which is a schematic view showing a two-dimensional chart that is made with the operation results of matrixes A and B and the second FRC pattern by means of software, it can be seen from the chart that this particular FRC pattern will not cause water ripple Issue and this FRC pattern can be used.

The operation result of matrixes A and B and the third FRC pattern is as flows:

$A^*C + B^*D =$

| | | | | | | | |
|---|---|---|---|---|---|---|---|
| 1 | 1 | 1 | 1 | 1 | 1 | 1 | 1 |
| −1 | −1 | −1 | −1 | −1 | −1 | −1 | −1 |
| 1 | 1 | 1 | 1 | 1 | 1 | 1 | 1 |
| −1 | −1 | −1 | −1 | −1 | −1 | −1 | −1 |
| 1 | 1 | 1 | 1 | 1 | 1 | 1 | 1 |
| −1 | −1 | −1 | −1 | −1 | −1 | −1 | −1 |
| 1 | 1 | 1 | 1 | 1 | 1 | 1 | 1 |
| −1 | −1 | −1 | −1 | −1 | −1 | −1 | −1 |

Figure 9:
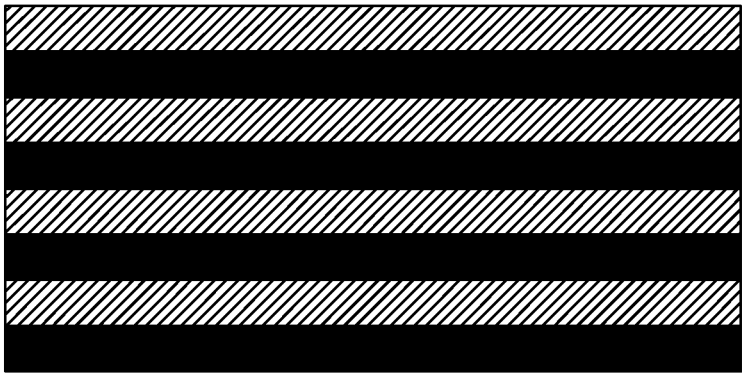
FIG. 9 is a schematic view showing a two-dimensional chart prepared according to the result of operation made on matrixes C and D that are obtained by expanding a third FRC pattern and matrixes A and B according to the method for selecting FRC pattern of the present invention.

Referring to FIG. 9, which is a schematic view showing a two-dimensional chart that is made with the operation results of matrixes A and B and the third FRC pattern by means of software, it can be seen from the chart that this particular FRC pattern will cause water ripple Issue and this FRC pattern cannot be used.

Step 7: prompting that no FRC pattern can be used if all the FRC patterns have been tested and no result indicating there is no bright/dark strips can be obtained.

It is can be seen from the two-dimensional charts obtained with operations made on the first, second, and third FRC patterns that the second FRC pattern causes no water ripple. Thus, the second FRC pattern can be used.

Proof is made by using COST MT3151A05 module and various inversion methods and FRC patterns are adopted to verify the result obtained with the operation method according to the present invention. The results are listed as follows:

| Inversion | FRC pattern | Prediction on Water Ripple or not | Water Ripple Observed or not |
|---|---|---|---|
| Single Dot Inversion | H | Yes | Yes |
| | I | | |
| | J | No | No |
| | K | | |
| Line Inversion | H | Yes | Yes |
| Two Dot inversion | I | No | No |
| Third Dot inversion where H is: 1 0 1 0 / 1 0 1 0 / 0 1 0 1 / 0 1 0 1 | | Yes | Yes |

-continued

I is:

| | | | |
|---|---|---|---|
| 0 | 1 | 0 | 1 |
| 0 | 1 | 0 | 1 |
| 1 | 0 | 1 | 0 |
| 1 | 0 | 1 | 0 |

J is:

| | | | |
|---|---|---|---|
| 1 | 0 | 1 | 0 |
| 0 | 1 | 0 | 1 |
| 1 | 0 | 1 | 0 |
| 0 | 1 | 0 | 1 |

and K is:

| | | | |
|---|---|---|---|
| 0 | 1 | 0 | 1 |
| 1 | 0 | 1 | 0 |
| 0 | 1 | 0 | 1 |
| 1 | 0 | 1 | 0 |

The result of verification given above shows that the operation of the present invention can correctly predict whether water ripple issue may occur for certain inversion methods and corresponding FRC patterns and eliminate the water ripple issue for dark-state pure-color grey-level images.

In summary, the present invention provides a method for selecting FRC pattern, which makes operation on a matrix that is obtained by expanding a dark-state grey-level FRC pattern and matrixes that are obtained by expanding polarity distribution charts of two adjacent frames of a pure color image displayed on a display panel according to a predetermined operation formula and prepares a two-dimensional chart with result of the operation by means of software in order to realize easy determination of whether the FRC pattern will cause water ripple and preventing the FRC pattern from causing water ripple issue.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A method for selecting frame rate conversion (FRC) pattern, comprising the following steps:

(1) providing a display device, wherein the display device comprises: a display panel, a signal controller electrically connected to the display panel, and a data driver that drives the display panel, the signal controller comprising: a look-up table and a data processor electrically connected to the look-up table, the look-up table storing a plurality of different FRC patterns;

(2) the data driver driving the display panel to display a pure color image, the signal controller supplying polarity distribution charts of two adjacent frames of the pure color image by applying an inversion operation and expanding the polarity distribution charts to m×n dimensions, where m and n are integer multiples of four;

(3) establishing matrixes A, B that respectively correspond to the two frames according to the two frames;

(4) the data processor selecting and retrieving one of the FRC patterns from the look-up table and expanding the FRC pattern to matrixes C, D of m×n dimensions;

(5) the data processor taking an operation on matrixes A, B, C, and D according to the formula A.*C+B.*D and making a two-dimensional chart on the result of the operation, wherein the symbol ".*" indicates element-wise product of two individual matrixes, where each of the elements of the matrix product is equal to the multiplication of the elements of the two individual matrix at a position corresponding to that of the matrix product; and (6) retrieving a next one of the FRC patterns from the look-up table if the two dimensional chart shows a bright/dark strip and repeating steps (4), (5), and (6), wherein steps (4), (5), and (6) are repeated for each of the FRC patterns of the look-up table until no bright/dark strip shows.

2. The method for selecting FRC pattern as claimed in claim 1, wherein after step (6), step (7) is further included to prompt that no FRC pattern can be used if all the FRC patterns have been tested and no result indicating there is no bright/dark strips can be obtained.

3. The method for selecting FRC pattern as claimed in claim 1, wherein the inversion operation of step (2) comprises dot inversion and line inversion.

4. The method for selecting FRC pattern as claimed in claim 3, wherein the dot inversion operation comprises: single-dot inversion, two-dot inversion, and three-dot inversion.

5. The method for selecting FRC pattern as claimed in claim 1, wherein in step (3), positive polarity in the polarity distribution charts corresponds to an element "+1" of the matrixes A, B and negative polarity in the polarity distribution charts corresponds to an element "−1" of the matrixes A, B.

6. The method for selecting FRC pattern as claimed in claim 5, wherein in step (4), elements "0" and "1" are used to expand the FRC pattern into matrixes C, D of m×n dimensions.

7. The method for selecting FRC pattern as claimed in claim 1, wherein the plurality of FRC patterns is of 0.5 level.

8. The method for selecting FRC pattern as claimed in claim 7, wherein the look-up table stores three different FRC patterns.

9. The method for selecting FRC pattern as claimed in claim 7, wherein each of the FRC patterns is in the form of a 4×4 data matrix.

10. The method for selecting FRC pattern as claimed in claim 1, wherein the display panel comprises a plurality of pixels.

11. A method for selecting frame rate conversion (FRC) pattern, comprising the following steps:

(1) providing a display device, wherein the display device comprises: a display panel, a signal controller electrically connected to the display panel, and a data driver that drives the display panel, the signal controller comprising: a look-up table and a data processor electrically connected to the look-up table, the look-up table storing a plurality of different FRC patterns;

(2) the data driver driving the display panel to display a pure color image, the signal controller supplying polarity distribution charts of two adjacent frames of the pure color image by applying an inversion operation and expanding the polarity distribution charts to m×n dimensions, where m and n are integer multiples of four;

(3) establishing matrixes A, B that respectively correspond to the two frames according to the two frames;

(4) the data processor selecting and retrieving one of the FRC patterns from the look-up table and expanding the FRC pattern to matrixes C, D of m×n dimensions;

(5) the data processor taking an operation on matrixes A, B, C, and D according to the formula A.*C+B.*D and making a two-dimensional chart on the result of the operation, wherein the symbol ".*" indicates element-wise product of two individual matrixes, where each of the elements of the matrix product is equal to the multiplication of the elements of the two individual matrix at a position corresponding to that of the matrix product; and (6) retrieving a next one of the FRC patterns from the look-up table if the two dimensional chart shows a bright/dark strip and repeating steps (4), (5), and (6), wherein steps (4), (5), and (6) are repeated for each of the FRC patterns of the look-up table until no bright/dark strip shows; and wherein after step (6), step (7) is further included to prompt that no FRC pattern can be used if all the FRC patterns have been tested and no result indicating there is no bright/dark strips can be obtained;

wherein the inversion operation of step (2) comprises dot inversion and line inversion;

wherein the dot inversion operation comprises: single-dot inversion, two-dot inversion, and three-dot inversion;

wherein in step (3), positive polarity in the polarity distribution charts corresponds to an element "+1" of the matrixes A, B and negative polarity in the polarity distribution charts corresponds to an element "−1" of the matrixes A, B;

wherein in step (4), elements "0" and "1" are used to expand the FRC pattern into matrixes C, D of m×n dimensions;

wherein the plurality of FRC patterns are of 0.5 level;

wherein the look-up table stores three different FRC patterns; wherein each of the FRC patterns is in the form of a 4×4 data matrix; and wherein the display panel comprises a plurality of pixels.

* * * * *